US005846334A

United States Patent [19]

Hoce

[11] Patent Number: 5,846,334

[45] Date of Patent: Dec. 8, 1998

[54] METHOD FOR REMOVAL AND CONTAINMENT OF CONTAMINATED OR HAZARDOUS MATERIAL

[76] Inventor: John Michael Hoce, 3714 SW. 56th Rd., Gainesville, Fla. 32608

[21] Appl. No.: 555,663

[22] Filed: Nov. 13, 1995

[51] Int. Cl.[6] ..... B08B 5/04

[52] U.S. Cl. ..... 134/21; 134/42; 15/353

[58] Field of Search ..... 134/21, 25.1, 42; 588/249; 15/353

[56] References Cited

U.S. PATENT DOCUMENTS

| | | | |
|---|---|---|---|
| 3,570,222 | 3/1971 | Dudek et al. | 55/472 |
| 4,158,575 | 6/1979 | Townsend | 134/21 X |
| 4,231,133 | 11/1980 | Probost | 15/422.2 |
| 4,839,061 | 6/1989 | Manchak, Jr. et al. | 210/743 |
| 4,969,311 | 11/1990 | Nutter et al. | 134/21 X |
| 5,026,432 | 6/1991 | Johnson | 134/21 |
| 5,032,184 | 7/1991 | Ogilvie et al. | 134/21 |
| 5,108,471 | 4/1992 | Poborsky | 55/186 |
| 5,287,587 | 2/1994 | Yonkers | 15/320 |
| 5,287,589 | 2/1994 | Hughes | 15/321 |
| 5,302,210 | 4/1994 | Whyte | 134/25.1 |
| 5,406,019 | 4/1995 | Dean | 588/249 |

*Primary Examiner*—Jill Warden
*Assistant Examiner*—Saeed Chaudhry
*Attorney, Agent, or Firm*—Quarles & Brady

[57] ABSTRACT

A novel method useful for rapid and efficient recovery and containment of liquid or particulate spills is provided and employs a unique portable vacuum device having a motor-driven pump or blower and a collection drum which can serve as a vacuum chamber.

5 Claims, 2 Drawing Sheets

METHOD FOR REMOVAL AND CONTAINMENT OF CONTAMINATED OR HAZARDOUS MATERIAL

BACKGROUND OF THE INVENTION

Spill recovery and containment of contaminated or hazardous liquid or particulate material is a continuous problem for industries that encounter such spills in their normal course of business. For example, the airline industry is faced with frequent spills of jet fuel or other petroleum products, as well as harsh or potentially environment-damaging chemicals, e.g., cleansers, which are used in routine procedures. Essentially, any industry handling potentially harmful material is subject to legal, economic, and other consequences resulting from delayed, inadequate, or otherwise improper recovery of contaminated or hazardous spills. Potentially harmful products, whether they pose environmental hazards or health threats, are subject to spillage or leakage at any time during their transport or usage, requiring rapid and efficient removal, containment, and disposal in accordance with local, state, or federal laws or regulations. Nearly all manufacturing and transportation industries face similar problems.

Spills of hazardous and flammable liquids present special concerns for rapid and complete recovery. Methods of recovery and collection include the use of standard or oversize mops and buckets with wringers, roller sponges, or electric shop vacs for non-flammable recovery, plus an adequate quantity of liquid-absorbing particles. One notable disadvantage of the sponge roller device is that after its use the spill "footprint," as the term is known in the art, may be increased as compared to the size of the footprint that was evident at the start of the cleanup procedure. Another disadvantage of the absorbent roller sponge device or other means described above is that the spilled contents must be manually emptied into a drum for disposal. This method of spill recovery and containment, combined with the use of several bags of absorbent particles which are commonly used to dam the spill and prevent its spread, involve large amounts of time and manpower, and create a significant amount of hazardous waste for future shipments.

Attending to the recovery of such spills by using these methods and devices is labor intensive, therefore high cost, and can require one or more workers who are specially trained in recovery of hazardous or contaminated material recover to be available for rapid deployment. In a typical fuel spill situation, bags of absorbent particles must be rushed to the spill site to be poured around the perimeter of the spill to prevent spreading and consequent contamination of a larger area. Next, roller sponges, mops, or "hand stroke" operated squeegees or shop vacs are moved back and forth through the spill, removing only a few gallons at a time before having to be emptied into larger containers or drums for disposal. Finally, all absorbent particles must be collected and deposited in special disposal containers using brooms and shovels. These procedures and devices involve use of so much particle absorbent material that the volume of hazardous waste resulting from a spill often amounts to several times the volume of the spill.

Devices employing a vacuum for the recovery of liquid or particulate spills are known; however, many such devices have the disadvantage of operating by electric motors, which are incompatible with the collection of flammable materials. See, for example, U.S. Pat. Nos. 3,570,222; 4,231,133; 5,287,587. In addition, these devices fail to provide for collection of a material directly into a collection container that is approved for storage and disposal. Certain other cleaning and retrieval systems have been described, which are configured as a truck bed for collection of debris, and employ multiple compartmentations or require separation and/or filtering apparatus to perform their function. See, e.g., U.S. Pat. Nos. 5,108,471 and 5,287,589.

There has not been described, heretofore, a portable or mobile vacuum device capable of recovering spills of hazardous or contaminated liquid or particulate materials directly into a Department of Transportation (DOT)-approved 55-gallon drum, and capable of being operated rapidly, efficiently, and safely by a single individual. Thus, no other device is known which can perform full recapture of spills directly from the point of the spill into a DOT-approved container which is interchangeably mounted on the device for ease of replacement when full or when the spill has been recovered. The device of the subject invention is self-contained, requiring no connection to a separate power source or containment base unit during its operation.

BRIEF SUMMARY OF THE INVENTION

The subject invention concerns a method and a portable device for high-speed and efficient recovery and containment of liquid or particulate spills. The subject device comprises a motor, e.g., an air-cooled engine, which drives a regenerative air blower or pump to produce a vacuum within a collection drum, thereby using the drum for the dual purpose of collecting and as the vacuum chamber; and a displaceably positioned vacuum head connected to the collection drum by a collection hose, all of which are mounted on a wheeled or otherwise mobile frame.

It is an object of the subject invention to quickly and safely recapture contaminated or hazardous materials, even flammable materials, that have been spilled on a hard surface, e.g., cement or asphalt with or without coverings or sealants. It is a further object of the invention to permit the recovery and containment of such spill material directly into a DOT-approved 55-gallon drum on board a device of the subject invention by a single individual operating the device. Advantageously, when recovery of the spill is complete, or the drum of the subject device is full, the drum can quickly and easily be replaced by one person. The device can be fitted with rollers used to support the collection drum during operation of the device. The rollers facilitate loading and unloading of the drum. According to a preferred embodiment of the subject invention, the collection drum serves a dual purpose of containment of recovered materials, as well as acting as the vacuum chamber for suctioning the spilled material through a vacuum head placed directly at the point of the spill, through a recovery hose, and depositing the spill material directly into the collection drum. By using the collection drum as the vacuum chamber, contamination of the pump or blower, or a separate vacuum chamber, can be avoided.

A further object of the invention is that contaminated, hazardous, or flammable materials can be recovered more safely than by use of conventional recovery means. For example, because contact with the spill takes place at the leading edge of the machine, the operator of the device is not required to directly contact the spill material. By recovering the spill material directly into a collection drum, decontamination of components of the device is minimized. This can be especially advantageous in a situation where the sequential recovery of dissimilar materials is required. Only a quick change or replacement of a collection drum or a recovery hose may be required. Liquid propane (LP)-fueled models of the subject device can be safely used for indoor spill recovery. An explosion-proof engine and exhaust modifications enable operators to rapidly and safely recapture fuels and other flammable spills.

DETAILED DISCLOSURE OF THE INVENTION

The subject invention pertains to a unique and advantageous device which is useful for recovering and containing a spill of hazardous or contaminated liquid or particulate material. In a preferred embodiment, the device of the subject invention advantageously employs a motor-driven pump or air blower which creates a vacuum in a collection drum, enabling suction of the spilled liquid or particulate material from the spill site, typically a concrete, asphalt, or tile surface, through a vacuum head and into the same collection drum via a recovery hose connecting the vacuum head and collection drum. Each of the components of the subject invention, i.e., the vacuum head, recovery and suction hoses, collection drum, vacuum pump or blower, and motor, are mounted on a frame, or chassis, in a manner such that electrical or mechanical connection to an outside power or vacuum source are not required. The subject device is a completely self-contained, mobile unit which provides power, vacuum, and a recovery and containment means which can be operated rapidly and efficiently by a single person.

Figure 1:
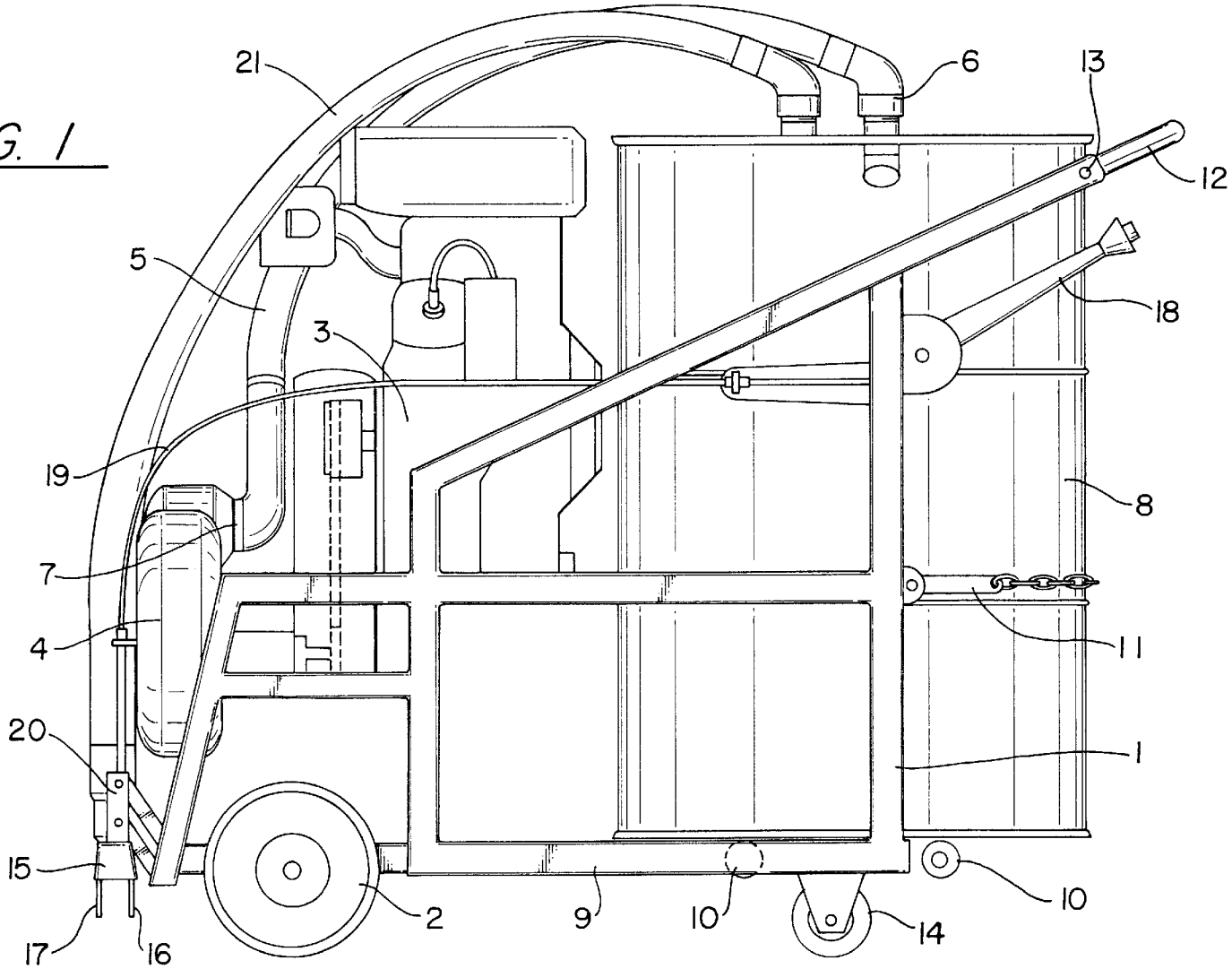
FIG. 1 is a side view representation of the device of the subject invention.
Figure 2:
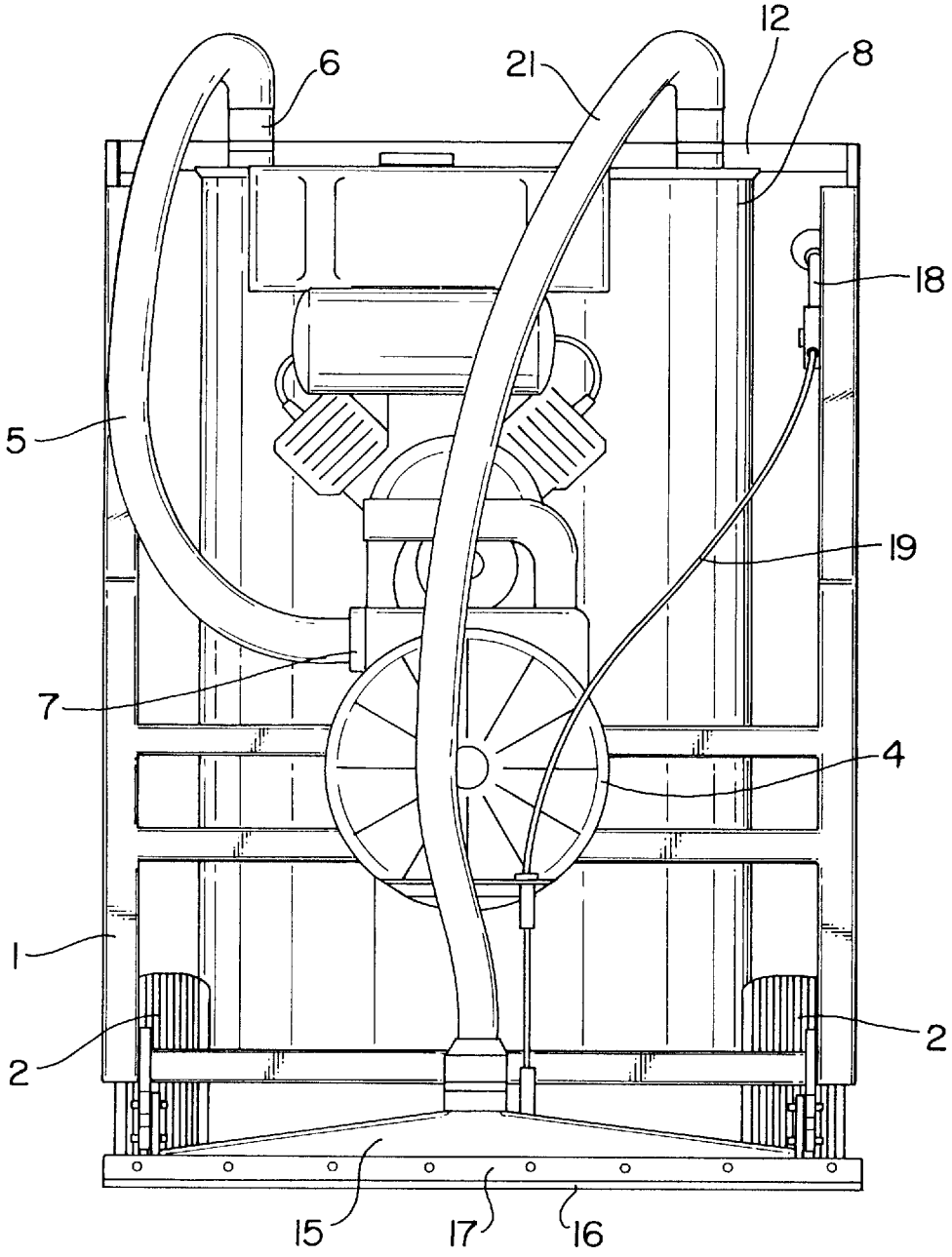
FIG. 2 is a front view representation of the device of the subject invention.

A preferred embodiment of the subject device can perhaps best be understood by referring to the drawings provided herein as FIGS. 1 and 2. The subject device comprises a frame chassis 1 for supporting the components of the device. The further components of the subject device include a motor, vacuum pump or air blower, vacuum head, connecting hoses, collection drum, and a means for providing mobility to the device, e.g., wheels or casters or a combination thereof The chassis can be framed from materials suitable for supporting the weight of the further components. For example, the frame chassis material can be metal, fiberglass, plastics, composites, or the like. In a preferred embodiment, the frame is a durable metal, and more preferably, is #304 stainless steel. The chassis has a forward end and a rearward end whereupon a wheel 2 can be affixed on each side of the forward end to provide a mobility means for the device. The wheels, which can be pneumatic or solid-formed neoprene, are commercially available, and can be attached to the chassis frame using an axle for each wheel, or the wheels can be affixed to the frame via engagement of an axle which connects between the wheels. Additional wheels can be affixed to the frame as needed. The preferred embodiment includes a first pair of wheels affixed to the forward end of the chassis and a second pair of wheels affixed to the rearward end of the chassis. In a more preferred embodiment, at least one pair of wheels can be made to swivel in order to facilitate steering or directing of the device. A most preferred embodiment of the invention includes a non-swivel first or forward pair of wheels and a pair of swivel casters as the second or rearward pair of wheels.

The frame can be fashioned to form a wheel well, above which can be placed a horizontal support on which the motor and pump apparatus can be positioned or mounted. The horizontal supports can be in the form of support bars or rods, or can be a substantially flat plate forming a flooring or mounting plate on which the motor and pump apparatus can be mounted and supported. A second horizontal support for the collection drum can be positioned toward the rearward end of the frame. The horizontal support for the collection drum can be a horizontal plate or support bars, but preferably comprises a plurality of steel support rollers. The size and shape of the chassis are not critical as long as the frame sufficiently provides support for the vacuum pump or blower, motor, vacuum head, and a 55-gallon collection drum.

The motor 3 can be any engine which provides sufficient power to the vacuum pump or air blower such that recovery of liquid or particulate material can be achieved. The motor can be a horizontal or vertical shaft engine with a centrifugal clutch for engaging the vacuum pump or air blower via a belt or chain. The motor can be fueled by petroleum fuels, e.g., diesel, ethanol, gasoline, methane or methanol, liquid propane (LP), or the like, or can be a battery charged electric engine. It is preferred to use an explosion-proofed, non-electric engine with appropriate spark-reducing exhaust modifications for situations where flammable materials may be recovered. A preferred embodiment of the invention includes an engine which produces at least 6 horsepower, e.g., in a diesel powered engine, but more preferably can be at least an 8-horsepower gasoline engine, and most preferably at least a 16-horsepower gasoline engine. In addition, an LP-fueled engine can be advantageous for indoor recovery and containment because of its reduced emissions of harmful gases. It is well known in the art that all engine applications can be explosion-proof modified for safe recovery of flammable materials.

The motor drives a vacuum pump or regenerative air blower 4 for production of vacuum in a vacuum chamber. In the subject invention, the vacuum chamber can be the collection drum, itself. The motor-driven vacuum pump or regenerative air blower used in accordance with the subject invention can be any appropriate pump or blower capable of producing a suction strength sufficient for lifting and removing a liquid or particulate material from a hard, substantially flat surface. In order to produce effective results for lift and recovery of liquid or particulate spills, it is preferred that the evacuation rate should be at least 200 cubic feet per minute (cfm), and produce an air speed of at least 4000 feet per minute. More preferably, the subject device can produce an evacuation rate of about 240 cfm and an air speed of at least about 5000 feet per minute. The vacuum produced by the pump or blower is communicated to a vacuum chamber by a first connecting hose 5, termed a suction hose. The suction hose is preferably, but not necessarily, made from a flexible material. In addition, the material for the suction hose is preferably non-porous and has a wall strength such that the vacuum created by the pump does not cause collapse of the hose. For example, reinforced vinyl or neoprene hoses can be used satisfactorily. Other hose materials which are commercially available can also be used as would be recognized by the ordinarily skilled artisan. The suction hose preferably has a fitting 6 and 7 at each end appropriate for connection to the pump or blower at one end of the hose, and connecting to the vacuum chamber or collection drum at the other end of the hose. The suction hose can be permanently affixed to the pump or blower or the vacuum chamber, but it is preferable to include removable clamps or fittings so that connection and removal of the hose is facilitated. Such connection fittings or clamps are well known and available commercially.

According to the subject invention, the vacuum chamber can also serve as the collection drum 8. Advantageously, the vacuum chamber/collection drum can be a polyethylene tank or barrel or, more advantageously, can be a barrel or drum which meets the approved standards of the Department of Transportation (DOT) or other government agency which is concerned with environmental or health issues relating to contaminated or hazardous material storage or disposal. DOT-approved drums usually have at least one threaded port, and typically have two threaded ports to which a hose fitting can be removably and threadably connected. For purposes of the subject invention, the two ports on the collection drum can serve respectively as a vacuum port and an intake port. The vacuum port is connected to the vacuum pump or blower via a suction hose, and the intake port is connected to the vacuum head via a recovery hose.

A further advantage of the subject device is that the collection drum can be removably mounted on the frame chassis. Horizontal longitudinal supports 9 on each side of the frame at the rearward end of the device can include, transverse thereto, a mounting plate or a roller bar or a plurality of roller bars 10 horizontally positioned across the width of the frame in order to support the collection drum during operation of the device. Providing roller bars can further facilitate the removal and replacement of a collection drum. In the preferred embodiment, the rollers are stainless steel. For example, an operator of the subject device can load an empty or incompletely filled collection drum onto the device by lifting the drum or leaning the drum on one end to place a portion of the bottom edge onto a most rearward roller bar. The drum can then easily be rolled toward the forward end of the device frame and into its normal operating position. Preferably, a horizontal bar placed about midway along the length of the frame can be used as a stop for the collection drum, effectively compartmentalizing the frame into a forward end for mounting the motor, vacuum head, and vacuum pump or blower, and a rearward end for supporting the collection drum in its operating position. This cross-bar also can add support and stability for the frame chassis. The cross-bar dividing the forward and rearward ends of the frame advantageously can also be concave to fit the curve of the drum and thereby provide additional support and stability to the drum. When the collection drum is full or the spill has been completely removed from a site, by use of the roller bars, the collection drum can easily be removed by a single operator of the device. The device having the collection drum in its normal operating position can be wheeled to an appropriate drum storage site, and the drum can then be rolled off the back and into its storage position by one person.

The normal operating position for the collection drum is toward the rearward end of the chassis, and can extend slightly beyond the rearward edge of the frame (see FIG. 1) in order to prevent excessive effort to remove or replace the collection drum. A strap or chain or other securing means 11 can be detachably affixed, e.g., by a hook means, to the rear frame to secure or help stabilize the collection drum in its operating position. The position of the securing strap or chain is preferably about one-third to about mid-height of the collection drum, but would be readily understood to be positionable at other heights in relation to the collection drum to achieve the result of securing or stabilizing the collection drum in its operating position.

Attached to the frame chassis, and preferably integral therewith, can be a steering or propelling means for an operator to control the direction and velocity of the device. In one embodiment, as shown in the attached figures, the steering means or propelling means can be a handle 12 in the form of a single handlebar or a pair of handles extending from, or being part of, the frame. The handlebar or handles are preferably positioned at a height which is ergonomically appropriate for an operator of the device. Typically, the handlebar or handles are positioned below the top edge of the collection drum. Therefore, in order to facilitate removal and replacement of the collection drum, said handlebar or handles are either vertically or laterally displaceable. In a preferred embodiment comprising a single handlebar extending completely around the back of a collection drum in its operating position, the handlebar can be hinged 13. In this embodiment, the hinged handlebar can be displaced vertically and toward the front of the device such that the handlebar clears the top of the collection drum, and removal or replacement of the drum is thereby unobstructed by the handlebar. Other displacement means for the handlebar, including a telescoping joint connecting the handlebar with the frame, a laterally displaceable hinged bar, or a completely removable bar, are also contemplated by the subject invention.

In addition to the handlebar or handles useful for steering the device, at least one, and preferably two, casters, e.g., swivel casters 14, can be affixed to the underside of the rearward end of the chassis frame, preferably directly below the collection drum in its operating position. Rear casters can improve operator control leverage and can permit the entire unit to reverse direction within a distance of about six feet. A variety of appropriate casters are commercially available, and those of appropriate strength, durability, weight-bearing capacity, and mobility would be recognized by the skilled artisan.

For collection of the hazardous or contaminated material from the surface of the spill site, a vacuum head 15 can be affixed to the forward end of the chassis frame, preferably near, or forming, the leading edge of the device. The vacuum head can be various shapes or sizes but is preferably a substantially tapering hollow housing forming a nozzle having its broadest part positioned downward for optimum spill collection, and tapering or narrowing upwardly for directing the collected spill material into a second hose, referred to as the recovery hose for purposes of the subject invention. The vacuum head can be manufactured from a variety of materials including metal, plastic, resin, composite, fiberglass, or the like, and is preferably a substantially rigid material resistant to harsh chemical contaminants or hazardous materials. Most preferably, the vacuum head is made from stainless steel. The vacuum head at its widest point is also preferably an equivalent width as the frame chassis (see FIG. 2), typically about two to about three feet wide.

A more preferable embodiment of the subject invention includes a flexible blade 16, known in the art as a squeegee blade, affixed to the lower, rearward edge of the vacuum head, extending below the opening of the vacuum head, and laterally extending substantially the same width as the widest part of the vacuum head. The flexible squeegee blade, which can be any appropriate flexible material, e.g. rubber, plastic, neoprene, or the like, functions to directly contact the surface from which the spill is being removed, effectively being used in a similar manner as any squeegee device, and can thus improve the efficiency of the spill removal. In a most preferred embodiment, a second flexible squeegee blade 17 can be affixed to the lower leading edge of the vacuum head which can serve, for example, to enhance the suction capability by producing a more effective vacuuming surface for recovery of the spill. The leading squeegee blade is preferably slightly shorter in the downward direction than the rearward squeegee blade in order to allow liquid to pass underneath the leading squeegee blade, but not allowing the liquid to bypass the rearward blade. In addition, the leading squeegee blade can be notched in order to perform this same function, while allowing for simultaneous intake of air which can also improve the lift capability and recovery efficiency of the device. Advantageously, the configuration of a leading and rearward squeegee blade can improve the suctioning capacity of the device on a thin layer or film of a spilled liquid or particulate material.

In one embodiment of the invention, the position of the vacuum head in relation to the surface from which the spill is being removed can be adjusted to facilitate operation of the device or moving of the device when it is not in operation. For example, the vacuum head can be displaceably mounted on the leading edge of the frame chassis such that the vacuum head can be placed in an "up" position, i.e., the rearward squeegee blade is not in contact with the ground or surface, or a "down" position, i.e., the rearward squeegee blade is in direct contact with the ground or surface. Preferably, the vacuum head is slidably or hingeably affixed to the frame chassis so that the vacuum head can be positioned at a lowermost point for direct contact with the spill surface. Alternatively, to decrease the chance of dragging the vacuum head on the ground when it is desired not to do so, e.g. when the device is being moved but not being operated, the vacuum head can be slidably or hingeably raised to a higher position away from the spill surface. A more preferred embodiment includes a means for the operator to remotely raise or lower the vacuum head into or out of position for operation. For example, an embodiment of the subject invention having a remote vacuum head adjustment can include a mechanical actuator cable and lever which can perform the function of raising or lowering the vacuum head. For example, a lever 18 or switch can be affixed to the rearward end of the device within reach of an operator standing behind the device. The lever or switch can be connected via an actuator cable 19 to a mechanical means 20 for moving the vacuum head to its uppermost or lowermost position. It is contemplated that an electrically actuated positioning means for the vacuum head can also be employed with the subject device. The essence of this aspect of the subject invention is to provide a plurality of positions for the vacuum head according to the particular need at a particular time.

The vacuum head is attached to the collection drum via the second connecting hose, or recovery hose, 21 that can be the same as or similar to the first connecting hose described above as the suction hose. because of the adaptability of the subject device for removing and containing a variety of contaminated or hazardous materials, a suitable recovery hose can be used for a particular material being recovered. For example, in normal use, the device can be used for recovery of spilled fuels; therefore, a fuel-resistant or fuel-proof material can be preferred for the recovery hose, as well as any of the other components which can come into contact with spilled fuel. In view of the expected contact with contaminated, hazardous, or flammable materials by the recovery hose, it is preferred that the recovery hose be removably attached at each of its ends to the vacuum head and collection drum, respectively, so that the appropriate hose material can be utilized according to the nature of the material being recovered from the spill site. Fittings or clamps appropriate for removably connecting said hose from either the vacuum head or an intake port of the collection drum are well known in the art and are commercially available.

Additional features for the device of the subject invention include, in particular or preferred embodiments, a gauge or automatic shut-off valve affixed to the collection drum for indicating when the collection drum is full. For example, a floatball shut-off valve commonly known in the art can be employed using standard techniques to automatically interrupt operation of the device when the drum is full or at some predetermined level of collection drum capacity. Further, it would be understood that the engine can be adapted for propelling the device, i.e., a self-propelled device which can, accordingly, also include a means for engaging and disengaging the self-propelling device to initiate or discontinue movement of the device. The self-propelled device can also be fitted with a throttle means or a braking means. In addition, it is contemplated that the subject device can be adapted as a device on which the operator can ride, akin to a riding mower, small tractor, or forklift.

A still further embodiment of the subject invention can include headlights to ensure that the device is completely self-sustaining, even at night. Explosion-proof, battery-operated headlights are preferred for use with the subject device.

The subject invention further concerns a method for recovering or containing spills of liquid or particulate contaminated or hazardous material. The subject method comprises recovering a spill using vacuum suction to transfer the spill material from the site of the spill directly into a recovery or containment tank. Preferably, the recovery or containment tank can be a DOT-approved collection drum. The method of the subject invention advantageously employs a device of the subject invention, described herein, which is designed to recover contaminated, hazardous, or flammable material without contaminating many of the components of the device. Contaminated or hazardous materials which are recovered pass through a vacuum head and a recovery hose connected from the vacuum head directly to the collection drum. Only the recovery hose is thereby contaminated to any significant degree. However, it is another advantage of the subject invention that a contaminated hose can be re-used as long as it is not used with an incompatible material. Therefore, the connecting hose can be effectively recycled for use with similar contaminants. The vacuum head can be rinsed or wiped to remove any of the contaminating or hazardous material, and the drum is intended for containment of such material.

The method thus comprises operation of the subject device in response to a spill of hazardous, contaminated, or flammable liquid or particulate material. For example, an operator of the device can recover a spilled contaminated, hazardous, or flammable material by starting the motor which operates the vacuum pump and evacuates the vacuum chamber such that lift and suction at the opening of the vacuum head are sufficient to begin the recovery process. The operator can then proceed at a walking pace behind the device, directing the vacuum head directly over the area of the spill to allow the vacuum device to suction the spill material into the collection drum. Preferably, the operator will begin the recovery at an edge of the spill area and continue back and forth across the edge of the spill until the collection drum is filled or material is recovered to the degree that no additional suctioning will remove more material. In the event that a collection drum is filled before the spill is completely recovered, the device can be moved to an area where filled collection drums are stored. The filled collection drum is then capped and removed from the frame chassis, and replaced with an empty collection drum. The replacement collection drum is then positioned into operating position, attached with the suction and recovery hoses, and recovery continued at the spill site. It would be readily understood that various techniques for spill recovery would be appropriate depending on the type, size, and nature of the spill. Typically, any remaining liquid material is an amount that easily and rapidly evaporates.

In another embodiment of the subject method, in the case of a large or potentially spreading spill of liquid material, the operator can first encircle or effectively dam the area of the spill with an absorbent, e.g., a particulate absorbing material known in the art as SPEEDY-DRI, to prevent further spreading of the spill to an undesired area. The operator can then proceed with recovery of the liquid material as described. Following recovery of the liquid spill material, the operator can then direct the device over the absorbent dam and recover the particulate material. The vacuum suctioning power of the subject device advantageously recovers the particulate material without leaving significant residue that may require further cleanup.

A particular advantage of the subject method employing the subject device is that the operator can remain behind the device, keeping a safe distance from the spill area and avoiding any contact with the spilled contaminated, hazardous, of flammable material. In addition, because the spill material can be recovered directly into a DOT-approved collection drum, the operator further minimizes contact with the spill material by avoiding additional transfers of the material from a non-approved collection tank to an approved collection drum as would be required if previously-known devices and methods are employed.

It should be understood that the examples and embodiments described herein are for illustrative purposes only and that various modifications or changes in light thereof will be suggested to persons skilled in the art and are to be included within the spirit and purview of this application and the scope of the appended claims.

I claim:

1. A method for recovery and containment of a spill of liquid or particulate material selected from the group consisting of hazardous, contaminated, and flammable material, wherein said method comprises the steps of:

(a) providing a self-contained, portable device comprising a frame chassis for mounting or supporting components of the device wherein said components include a motor, a mobility means for moving said device, a steering or propelling means for directing or propelling said device, vacuum pump or regenerative blower, vacuum head, vacuum chamber, collection drum used as a vacuum chamber and having a vacuum port and an intake port, a suction hose, and a recovery hose (b) contacting the spill with vacuum head;

(c) depositing the recovered spill material directly into a collection drum used as a vacuum chamber and thereby bypassing the vacuum pump or regenerative blower.

2. The method, according to claim 1, wherein said collection drum is a container approved by the Department of Transportation for storing the recovered contaminated or hazardous or flammable material.

3. The method, according to claim 1, wherein said method further comprises, prior to recovery of the spill material, damming the spill using a particulate absorbent.

4. The method, according to claim 3, wherein said method further comprises recovery of the particulate absorbent material.

5. The method, according to claim 1, wherein said contaminated, hazardous, or flammable material is a petroleum fuel.

* * * * *